US007416191B2

(12) United States Patent
Yoshino

(10) Patent No.: US 7,416,191 B2
(45) Date of Patent: Aug. 26, 2008

(54) BINDING DEVICE FOR SNOWBOARD

(76) Inventor: Tadashi Yoshino, 302 Feliche III, 11-2 Saiwai-cho, 3-chome, Siwai-ku, Kawasaki (JP) 212-0011

( * ) Notice: Subject to any disclaimer, the term of this patent is extended or adjusted under 35 U.S.C. 154(b) by 0 days.

(21) Appl. No.: 11/652,477

(22) Filed: Jan. 12, 2007

(65) Prior Publication Data

US 2007/0164523 A1 Jul. 19, 2007

(30) Foreign Application Priority Data

Jan. 17, 2006 (JP) ..... 2006-008864

(51) Int. Cl.
*A63C 9/00* (2006.01)

(52) U.S. Cl. ..... 280/14.22; 634/607; 634/618; 634/14.24; 634/612

(58) Field of Classification Search ..... 280/14.22, 280/634, 607, 618, 14.24, 612
See application file for complete search history.

(56) References Cited

U.S. PATENT DOCUMENTS 5,954,357 A * 9/1999 Golling ..... 280/612
7,270,337 B1 * 9/2007 Carotenuto ..... 280/14.24
7,281,717 B2 * 10/2007 Sacco et al. ..... 280/14.22
2003/0230870 A1 * 12/2003 Sabol ..... 280/618

FOREIGN PATENT DOCUMENTS

JP 2003-024496 1/2003

* cited by examiner

*Primary Examiner*—Christopher Ellis
*Assistant Examiner*—Cynthia F. Collado
(74) *Attorney, Agent, or Firm*—Manabu Kanesaka

(57) ABSTRACT

A binding device for snowboard according to the invention includes: a base member mounted on a snowboard; a rotor member provided rotatably on the base member and having attaching means for attaching a binding device and fixing means for fixing a shoe on the top face thereof; a holding member mounted on the top face of the base member, for holding the rotor member rotatably; and restoring means provided between the base member or the holding member and the rotor member, for restoring the rotated rotor member to a reference position.

3 Claims, 14 Drawing Sheets

BINDING DEVICE FOR SNOWBOARD

BACKGROUND OF THE INVENTION

1. Field of the Invention

The present invention relates to a binding device for snowboard, and more particularly, to a binding device for snowboard, which is constructed to be rotable with respect to a snowboard.

2. Description of the Related Art

A binding device is used for fixing shoes to a snowboard. The binding device comprises a holder portion 62 for holding a shoe and a mounting plate 63 for mounting the holder portion 62 to a snowboard SB as shown in FIG. 15. The mounting plate 63 is fitted to a fitting hole 62*a* provided in the holder portion 62 and fixed to the snowboard SB by tightening plural screws 61 to screw holes provided in the snowboard SB.

Although not shown, a tooth arrangement is provided on the periphery of the fitting hole 62*a* in the holder portion 62*a*, and the same tooth arrangement is provided on the periphery of the mounting plate 63. By engaging both the tooth arrangements freely, the angle of the holder portion 62 relative to the snowboard SB, that is, the angle of the binding device 60 can be adjusted as indicated by arrows in the figure.

However, in such a binding device 60, although the angle of the holder portion 62 can be adjusted when it is attached, the angle thereof cannot be adjusted during use of the snowboard SB because the holder portion 62 is fixed to the snowboard SB with the screws 61.

Thus, the motion of the binding device 60, in other words, the motion of the foot is limited upon snowboarding and its snowboarding way is also restricted. If the foot is fixed upon snowboarding, a burden is applied to the knee, ankle or the like, so that, particularly, when a snowboarder falls down, the bone of his or her knee or ankle may be broken.

To solve such a problem, Japanese Patent Application Laid-Open No. 2003-24496 has proposed a setting device for a snowboard binding, which allows a binding device to rotate with respect to a snowboard SB during snowboarding.

The setting device 70 includes a base member 71 in which screw holes 71*a* for mounting to the snowboard and screw portions 71*b* for fixing a press-fit plate 74 are formed, as shown in FIG. 16. The base member 71 is fixed to a predetermined position of the snowboard with the screw holes 71*a* and screws (not shown) The base member 71 accommodates a bearing 72, and a rotating member 73 is mounted on the top of the bearing 72. The press-fit plate 74 covers the top of the rotation member 73 and holds the rotating member 73 rotatably.

The press-fit plate 74 has a through hole 74*a* and a cutout portion 74*b* through which a binding mounting portion 73*c* of the rotating member 73 is to be inserted. By mounting the press-fit plate 74 over the top of the rotating member 73, the binding mounting portion 73 and a projecting portion 75*b* of the rotating member 73 pass through the press-fit plate 74, so that the press-fit plate 74 makes a pressure contact with a jaw portion 73*b* of the rotating member 73.

The press-fit plate 74 which keeps a pressure contact with the jaw portion 73*b* of the rotating member 73 is fixed to the base member 71 by inserting the screw portions 71*b* of the base member 71 through screw holes in the press-fit plate and tightening nuts 74*c*.

A screw hole is formed in the projecting portion 75*b* of the rotating member 73, and when a screw 75*a* is tightened from above, the screw 75*a* makes a pressure contact with the top face of the press-fit plate 74. Consequently, if a predetermined rotation force is applied to the rotating member 73, the rotating member 73 rotates with respect to the base member 71. Reference numerals 73*a* in FIG. 16 denote a screw hole for attaching the binding (not shown).

In the setting device for the snowboard binding, the angle of the binding can be changed freely because the rotating member 73 is constructed to be rotatable. Thus, a user can ride on/off a ski lift with the binding attached to the snowboard or move smoothly on a place without any slope, and during snowboarding, the binding (rotating member 73) can rotate with respect to the snowboard, so that user can enjoy free snowboarding.

However, in the above-mentioned setting device 70, once the binding (rotating member 73) rotates with respect to the snowboard, the user cannot help relying on his or her experiences or sense to return the binding (rotating member 73) to a reference position at an initial period of snowboarding. For the reason, this setting device is difficult to handle for a beginner or child because he or she cannot find out the reference position easily. Further, no means for restricting the rotation of the binding (rotating member 73) with respect to the snowboard is provided. For this reason, the binding (rotating member 73) is rotated more than necessary at the time of snowboarding, which provides a problem that the setting device cannot be handled easily.

Further, there is a danger that if the binding (rotating member 73) is rotated more than necessary due to an impact by fall-down or the like, an excessive load is applied to the joint of the knee, ankle or the like, thereby inducing an injury.

SUMMARY OF THE INVENTION

The present invention has been achieved to solve the above-described technical problems, and an object of the invention is to provide a binding device for snowboard in which a binding can be restored to its reference position accurately after rotation and the binding can be rotated within a set range which allows a snowboard to be controlled easily even during snowboarding in order to reduce a burden applied to the joint of the knee, ankle or the like.

In order to achieve the above object, the present invention provides a binding device for snowboard comprising: a base member mounted on a snowboard; a rotor member provided rotatably on the base member and having attaching means for attaching a binding member and fixing means for fixing a shoe on the top face thereof; a holding member mounted on the top face of the base member, for holding the rotor member rotatably; and restoring means provided between the base member or the holding member and the rotor member, for restoring the rotated rotor member to a reference position.

As described above, the restoring means for restoring the rotated rotor member to the reference position is provided. As a consequence, if a certain force is applied to the rotor member to rotate the rotor member and then the applied force is released from the rotor member, the rotor member can be restored to the reference position by the restoring means.

Preferably, the restoring means is a spring member stretched between the base member or the holding member and the rotor member. The spring member may be of a linear material or sheet material or a coil spring.

Further, preferably, magnets having different magnetic poles are provided at opposing positions of the base member and the rotor member or at opposing positions of the holding member and the rotor member.

Because the magnets having different magnetic poles are provided at the opposing positions of the base member and the rotor member or at the opposing positions of the holding member and the rotor member, the rotor member can be restored to the reference position accurately.

A uses can be given a feeling of clicking due to the attraction effect of the magnet when the rotor member leaves the reference position or returns to the reference position. Consequently, the user can recognize that the rotor member has left the reference position and has been restored to the reference position.

Preferably, a rotor rotation blocking means is provided on the base member or the holding member, and the rotation of the rotor member is blocked when the rotor member comes into contact with the rotor rotation blocking means.

In this manner, the rotor rotation blocking means is provided. As a consequence, if the rotor member tries to rotate more than necessary, the rotor member comes into contact with the rotor rotation blocking means, so that the rotation of the rotor member is restricted.

As a result, even if a large force is applied to the rotor member by a shock due to fall-down or the like, no excessive load is applied to the joint of the knee, ankle or the like.

Further, preferably, the binding device further comprises a communication hole which is open in the base member or the holding member such that it communicates with the inside of the rotor member, so that the rotor member is fixed to the base member or the holding member by inserting a pin into the communication hole.

The binding member can be kept in a fixed position by fixing the rotor member so as not to be rotatable by inserting the pin into the communication hole, during snowboarding like conventionally.

As described above, according to the present invention, after the binding member (rotor member) is rotated, the binding member (rotor member) can be restored to a reference position accurately. Further, by keeping the binding member (rotor member) rotatable within a set range which allows the snowboard to be controlled easily during snowboarding, free snowboarding can be secured and a burden applied to the joint of the knee, ankle or the like can be reduced.

DESCRIPTION OF THE PREFERRED EMBODIMENTS

Figure 1:
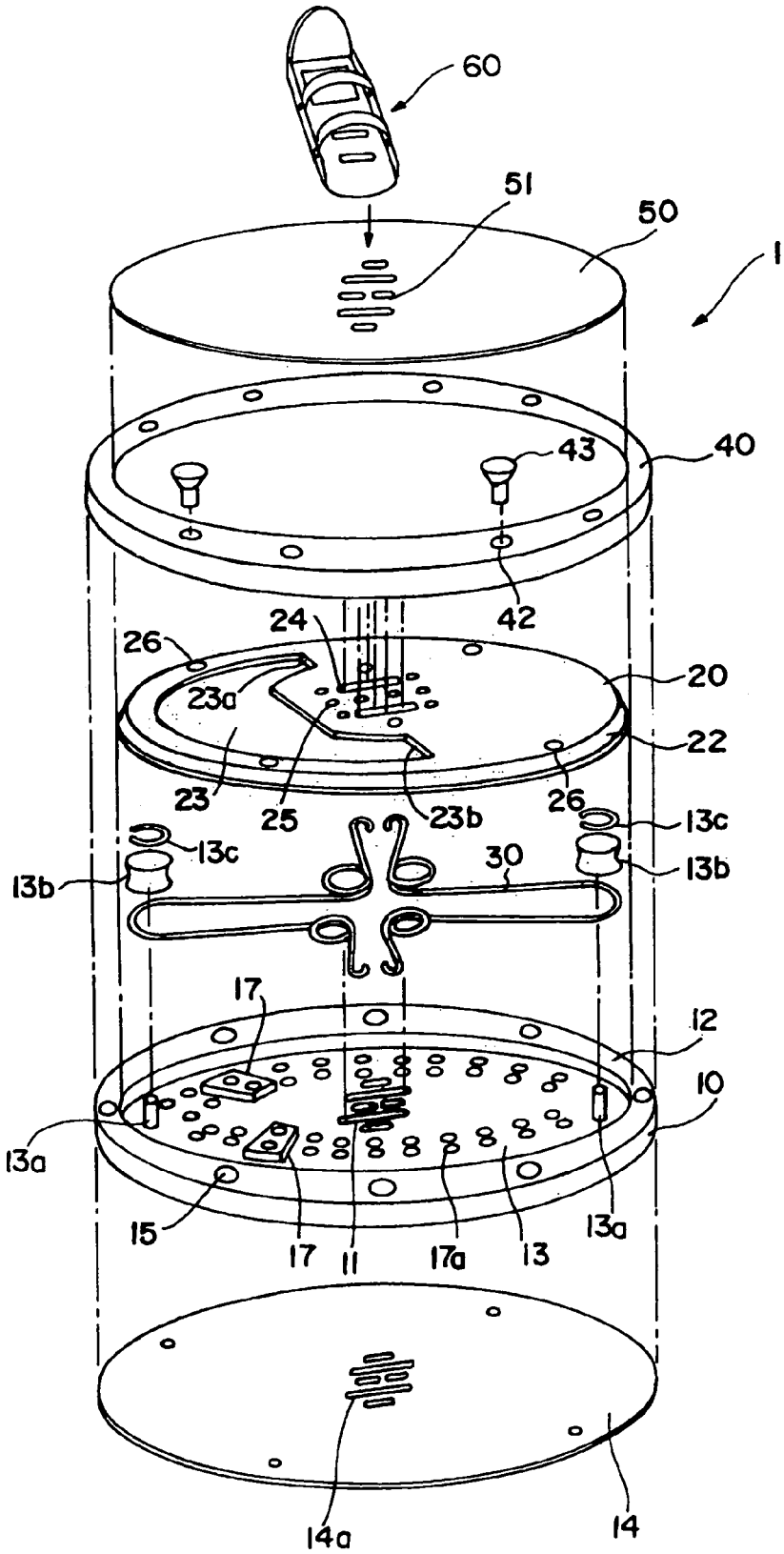
FIG. 1 is an exploded perspective view of a binding device for snowboard according to the invention.

Hereinafter, embodiments of a binding device for snowboard according to the present invention will be described with reference to the accompanying drawings. FIG. 1 shows an exploded perspective of the binding device for snowboard of the invention. The binding device includes a base member 10, rotor member 20, restoring means 30, holding member 40 and a protection plate 50. In the meantime, in each figure of this embodiment, the protection plate 50 is represented as a transparent one to facilitate understanding of an internal structure.

First, the base member 10 is a disk-like metal member having a mounting portion 11 for mounting to a snowboard (not shown) as shown in FIG. 1. A step portion 12 is provided on the periphery of the base member 10, and an accommodating portion 13 for accommodating the rotor member 20 is provided inside the step portion 12.

The mounting portion 11 includes a plurality of elongated holes provided in the center of the base member 10. These elongated holes allow a mounting position of the binding device 1 to the snowboard to be adjusted.

When the base member 10 is attached to the snowboard, it is preferable to use a protective member 14 made of rubber. When the protective member 14 is used, the protective member 14 needs the same elongated holes 14*a* as in the mounting portion 11.

The accommodating portion 13 for the rotor member 20 is formed inside the step portion 12. The step portion 12 prevents the rotor member 20 accommodated in the accommodating portion 13 from shifting sideway (in the diameter direction) during snowboarding. The top face of the step portion 12 has eight screw holes 15 for attaching the holding member 40 at intervals of 45°.

The accommodating portion 13 has a slightly larger diameter than the diameter of the rotor member 20 so as to accommodate the rotor member 20 and allow the rotor member 20 to rotate inside thereof. The accommodating portion 13 has two limiters 17 as rotor rotation blocking means for blocking rotation of the rotor member 20 such that the rotor member 20 does not rotate over a certain angle.

Although in this embodiment, the two limiters 17 are mounted such that their center lines intersect each other at an angle of about 90°, they may be adjusted to an arbitrary angle with plural mounting holes 17*a* provided concentrically in the accommodating portion 13.

Figure 3:
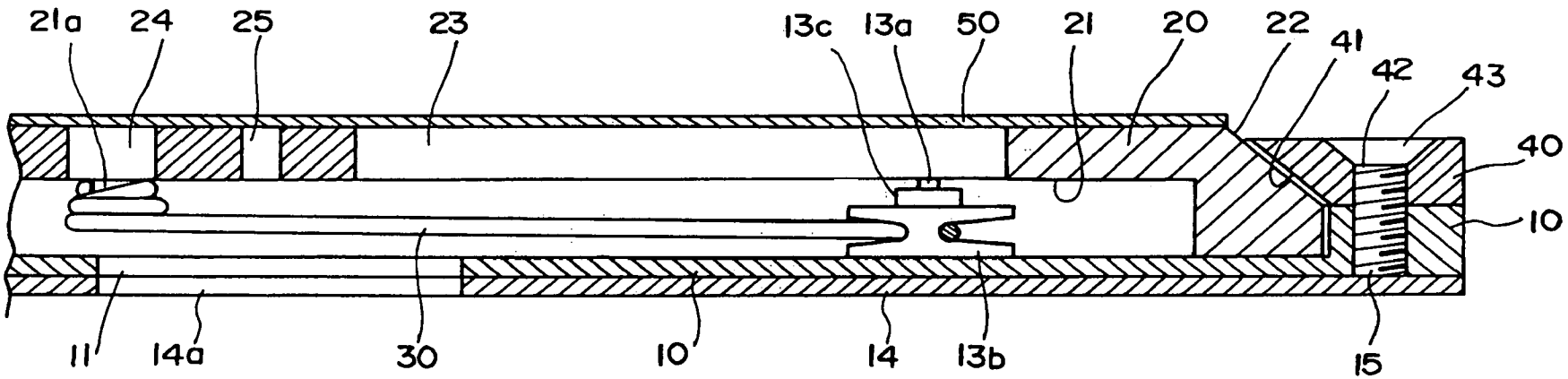
FIG. 3 is a sectional view taken along line A-A in FIG. 2.

The rotor member 20 is a disk-like metal member, and its rear face 21 is gouged into a concave form as shown in FIG. 3. The periphery of the top face of the rotor member 20 is tapered to an inclined portion 22.

Further, a fan-like opening portion 23 whose central angle is of a predetermined angle is provided in the rotor member 20.

Through holes 24 corresponding to screws in the mounting portion 11 of the base member 10 are provided in the center of the rotor member 20 so as to allow retightening of the mounting screws to the snowboard even in an assembled state. Eight screw holes 25 for mounting a binding member 60 are provided around the through holes 24. Some type of the binding device can be fixed to the through holes. In that case, provision of the through holes can satisfy the purpose instead of the screw holes.

Figure 4:
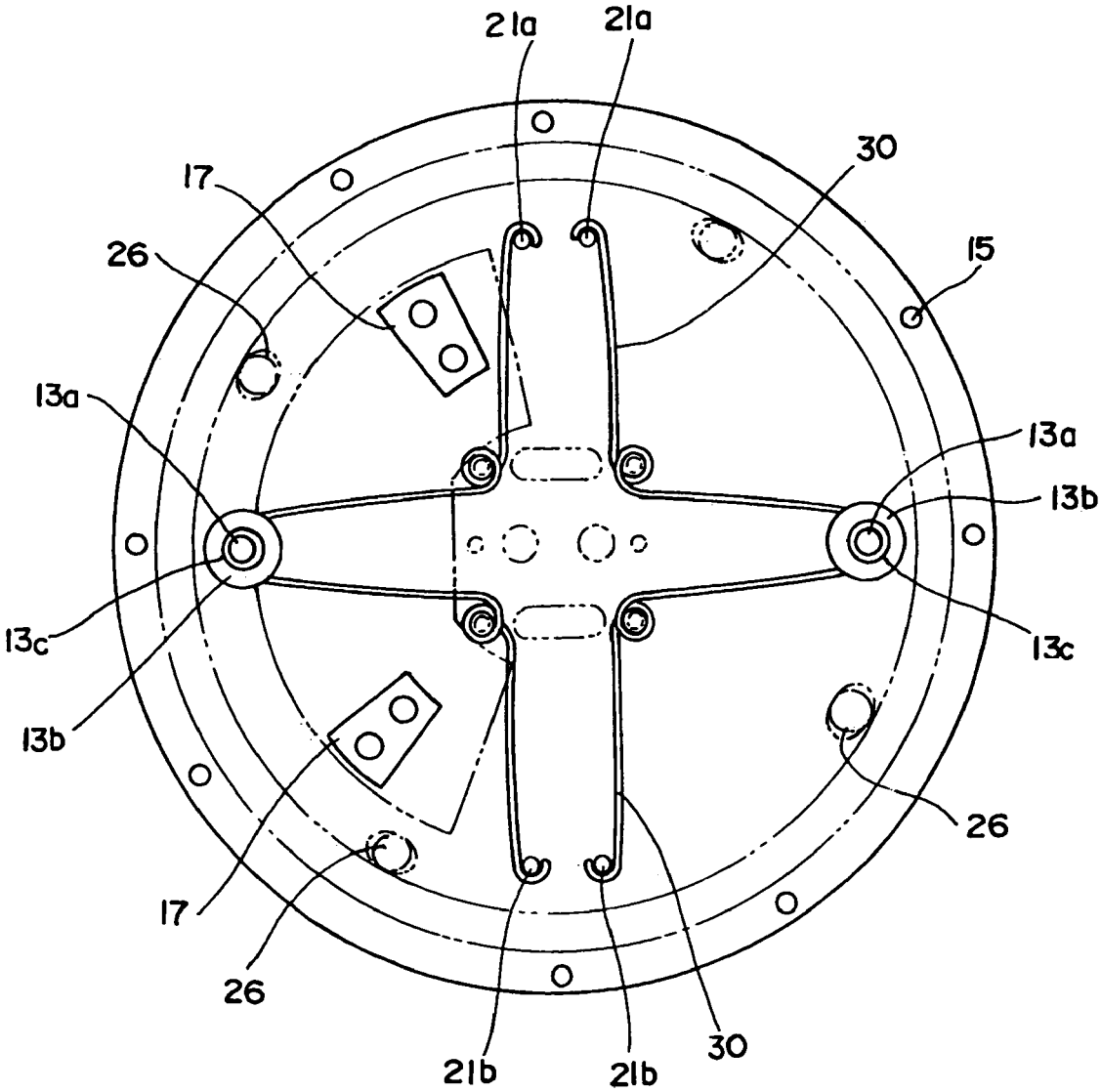
FIG. 4 is a schematic explanatory view of restoring means of the binding device for snowboard according to the invention.
Figure 5:
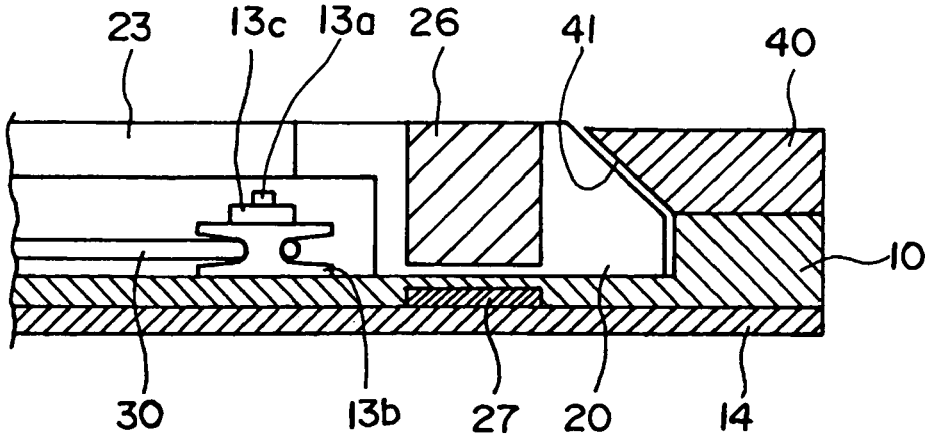
FIG. 5 is a sectional view taken along line B-B in FIG. 2.

As shown in the schematic explanatory view of the restoring means in FIG. 4, the restoring means 30 for restoring the rotated rotor member 20 to its reference position is stretched between the base member 10 and the rotor member 20.

To explain in detail, one end of the restoring means 30 composed of a spring member is engaged with an engaging member 21*a* provided on the rear face 21 of the rotor member 20. The restoring means 30 composed of a spring member is stretched from an engaged end and draws a spiral in the center of the rotor member 20 to change the direction at substantially 90°, and then changes the direction at substantially 180° at a roller 13*b* provided in the accommodating portion 13 of the base member 10. The restoring means 30 is stretched to the center and further draws a spiral to change the direction at substantially 90°. Finally, the other end of the restoring means 30 is engaged with an engaging member 21*b* provided on the rear face 21 of the rotor member 20.

The roller 13*b* is provided rotatably on a pin 13*a* and an E-type ring 13*c* is attached to the top of the pin 13*a* so as to block the roller 13*b* from running out of the pin 13*a*.

The restoring means 30 having the same configuration as the aforementioned restoring means is stretched at a position symmetrical with respect to the base member 10 between the base member 10 and the rotor member 20 although description thereof is omitted because it is apparent from the drawing.

With such a configuration, if a certain force is applied to the rotor member 20 and the force is released after the rotor member 20 rotates, the rotor member 20 can be restored to its reference position by the restoring means 30 composed of a spring member. In the meantime, although the linear spring member is exemplified as the restoring means 30, the restoring means 30 is not restricted to this example but may be of a sheet member or of a coil spring.

Positioning magnets 26 are mounted at four positions at intervals of 90° on the periphery of the rotor member 20. On the other hand, a magnet 27 having a difference magnetic pole is attached at a position corresponding to the magnet 26 on the rear face of the base member 10. That is, the rotor member 20 cannot be restored to an accurate reference position with only the restoring means 30, and by using the upper and lower magnets 26, 27, the rotor member 20 can be restored to the accurate reference position.

When the rotor member 20 leaves the reference position, a user can be given a feeling of clicking due to effects of the magnets 27, 26, so that the user can recognize that the rotor member 20 has left the reference position. Likewise, when the rotor member 20 is restored to the reference position, a user can be given a feeling of clicking, so that the user can recognize that the rotor member 20 has been restored to the reference position.

If a large force is applied to the rotor member 20 due to fall down or the like, the rotation of the rotor member 20 cannot be restricted fully by the restoring means 30 alone. Thus, the accommodating portion 13 of the base member 10 is provided with the two limiters 17 for restricting the rotation of the rotor member.

That is, when the rotor member 20 tries to rotate more than necessary, the limiter 17 comes into contact with an end portion 23*a* (23*b*) of the opening portion 23 in the rotor member 20, thereby restricting the rotation of the rotor member 20. As a result, even if a large force is applied to the rotor member 20 due to an impact upon fall down or the like, the rotation of the rotor member 20 is restricted by the limiter 17 to prevent an excessive load from being applied to the joint of the knee, ankle or the like.

The holding member 40 is a ring-like metal member for restricting a fall of the rotor member 20 and an inclined face 41 corresponding to the inclined portion 22 of the rotor member 20 is formed on the inner side face of the holding member 40. That is, the inclined face 41 restricts the rotor member 20 from moving upward, thereby preventing the rotor member 20 from slipping out. The holding member 40 is provided with through holes 42 through which a screw 43 passes at positions corresponding to the screw holes 15 in the base member 10.

The protection plate 50 prevents an invasion of snow or dirt through the opening portion 23 or the like of the rotor member 20. Consequently, the rotor member 20 can rotate without being blocked by an invasion of snow, dirt or the like. The protection plate 50 is composed of a circular thin plate of plastic, and is fixed by being attached by the binding member 60 so as to cover the surface of the rotor member 20. Thus, a plurality of elongated holes 51 are provided in the protection plate 50 corresponding to the binding mounting screw holes 25 in the rotor member 20.

The elongated holes 51 are formed corresponding to the mounting portion 11 in the base member 10 and the through holes 24 in the rotor member 20, whereby the screws for fixing the base member 10 to the snowboard can be retightened by inserting a screw driver through the elongated hole 51 and through hole 24 with the binding member 60 mounted to the rotor member 20.

Figure 2:
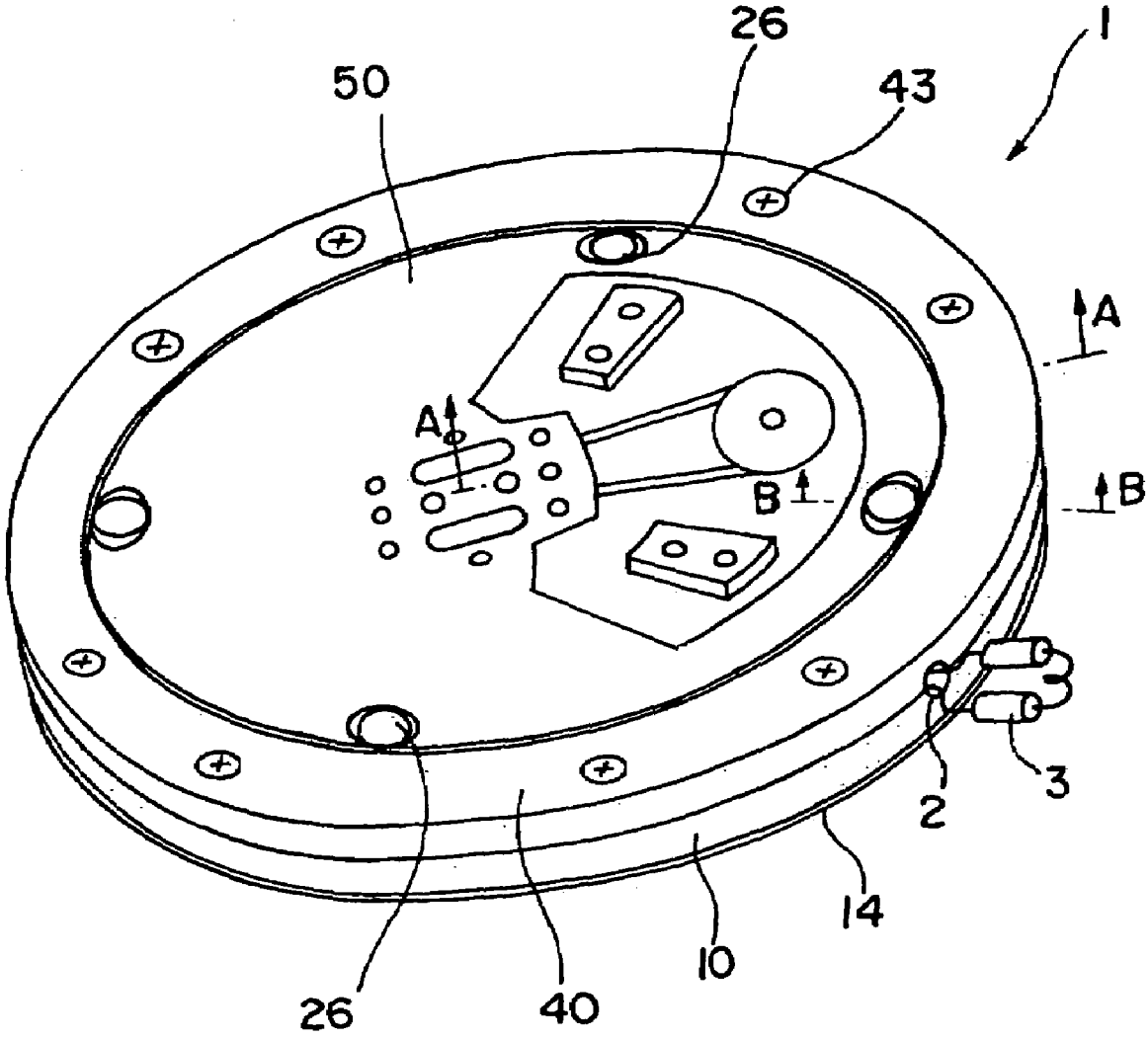
FIG. 2 is a perspective view of the binding device for snowboard according to the invention.
Figure 6:
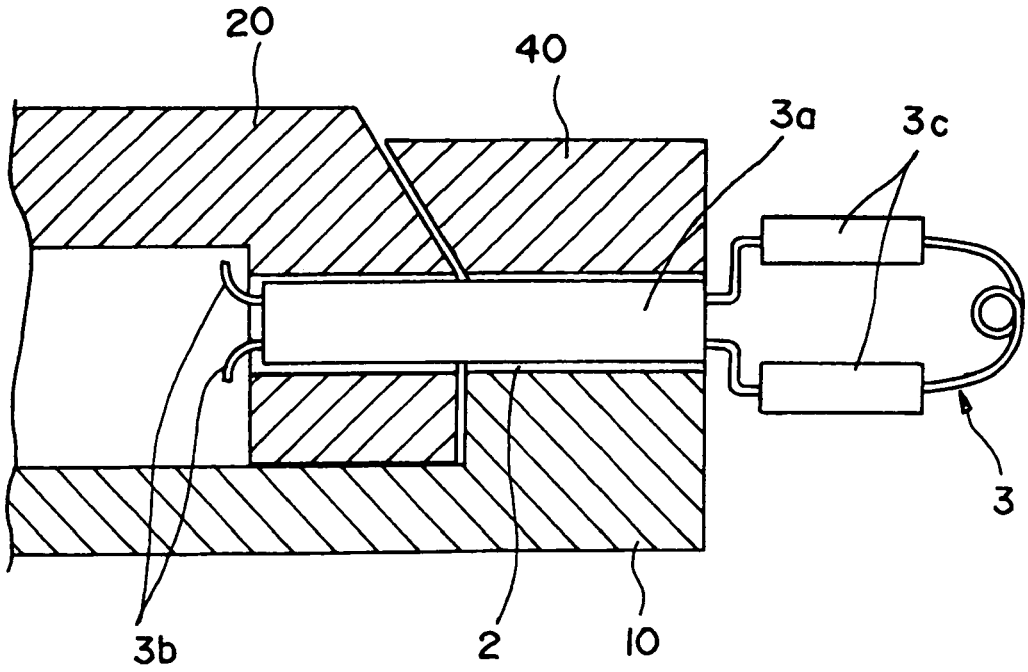
FIG. 6 is a schematic explanatory view showing a state in which a rotor member is fixed.

As shown in FIGS. 2 and 6, a communication hole 2 which communicates with the inside of the rotor member 20 is formed, the communication hole 2 having an opening formed in the holding member 40 and the base member 10 across a border therebetween. By inserting a pin 3 into the communication hole 2, the rotor member 20 is blocked by the pin 3, so that the rotation of the rotor member 20 is prevented.

As shown in FIG. 6, the pin 3 has a metal cylindrical portion 3*a* having a substantially equal length as the communication hole 2, and bent end portions 3*b* are projected from the cylindrical portion 3*a*. The pin 3 is so constructed that the end portions 3*b* are contracted/expanded by the spring action by pressing a grip portion 3*c* or releasing the grip thereof.

That is, the end portions 3*b* are contracted by pressing the grip portion 3*c*, and the pin 3 is inserted into the communication hole 2. Then, by releasing the press on the grip portion 3*c*, the end portions 3*b* are engaged with the inner wall face of the rotor member 20 to fix the rotor member 20 such that it is not rotatable. As a consequence, the binding member 60 can be fixed like conventionally upon snowboarding.

By removing the pin 3 from the communication hole 2 by pressing the grip portion 3*c* to contract the end portions 3*b*, the rotor member 20 can rotate freely.

Although the communication hole 2 has been described about a case where it is open across side walls of the holding member 40 and the base member 10 such that it communicates with the inside of the rotor member 20, the communication hole may be open in the top face of the rotor member 20 communicating with the inside of the base member 10. In this case also, by inserting the pin into the communication hole, the rotor member 20 is restricted by the pin thereby blocking the rotation of the rotor member 20.

Upon mounting the binding device for snowboard of the present invention to a snowboard, the base member 10 is first attached to a predetermined position of the snowboard. With the magnets 27 on the base member 10 matching with the magnets 26 on the rotor member 20, the rotor member 20 is attached to the base member 10. At this time, as described above, the restoring means 30 is stretched between the base member 10 and the rotor member 20.

The holding member 40 is mounted on the step portion 12 of the base member 10, and the holding member 40 is fixed to the base member 10 with the screws 43.

At this time, hardness of the rotation of the rotor member 20, chattering thereof and the like can be adjusted by inserting a spacer sheet (not shown) into a contact portion between the base member 10 and the holding member 40 or a contact portion between the base member 10 and the rotor member 20.

After the protection plate 50 is mounted on the top of the rotor member 20, the binding member 60 is fixed to the screw holes 25 for binding mounting in the rotor member 20 with screws. Even in a state that the binding member 60 is attached to the rotor member 20, the screws for fixing the base member 10 to the snowboard can be retightened by passing the screw driver through the elongated hole 51 and the through hole 24.

Figure 8:
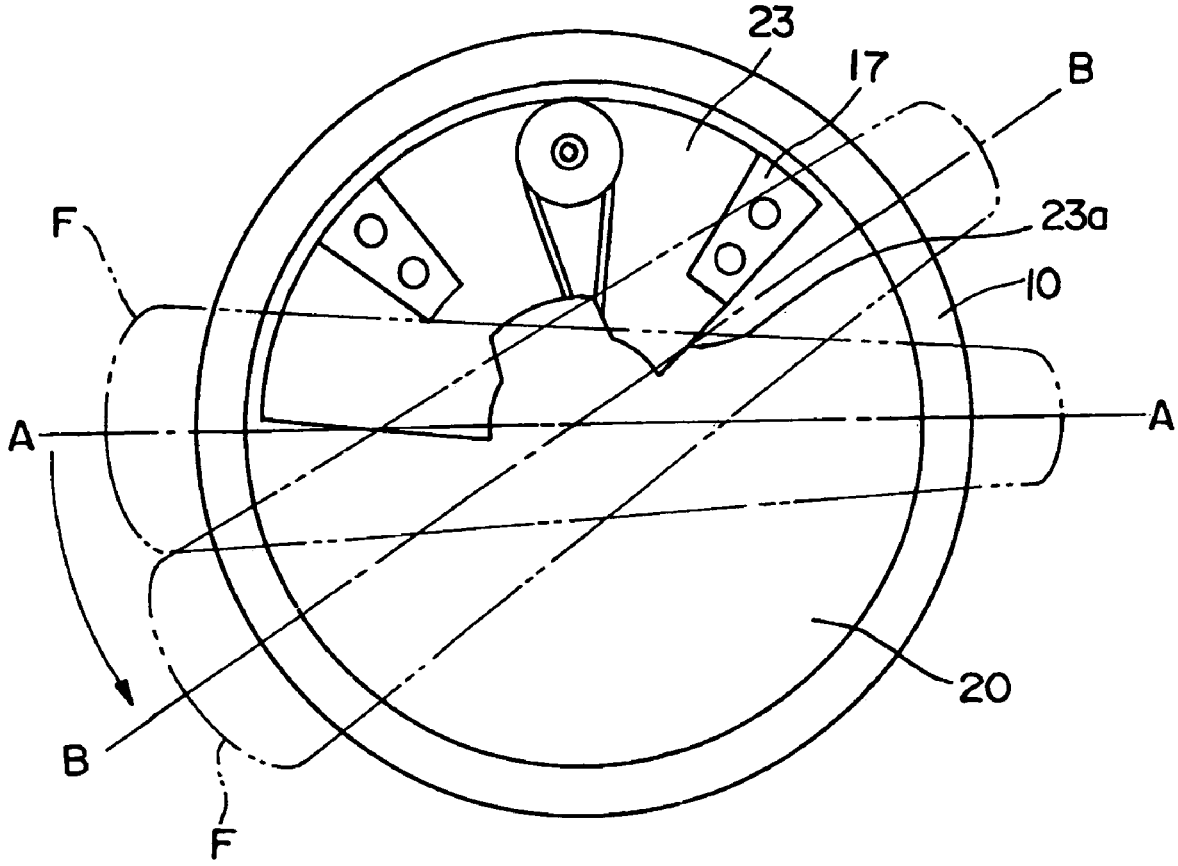
FIG. 8 is a schematic explanatory view showing a rotating state of the rotor member in a counterclockwise direction.
Figure 9:
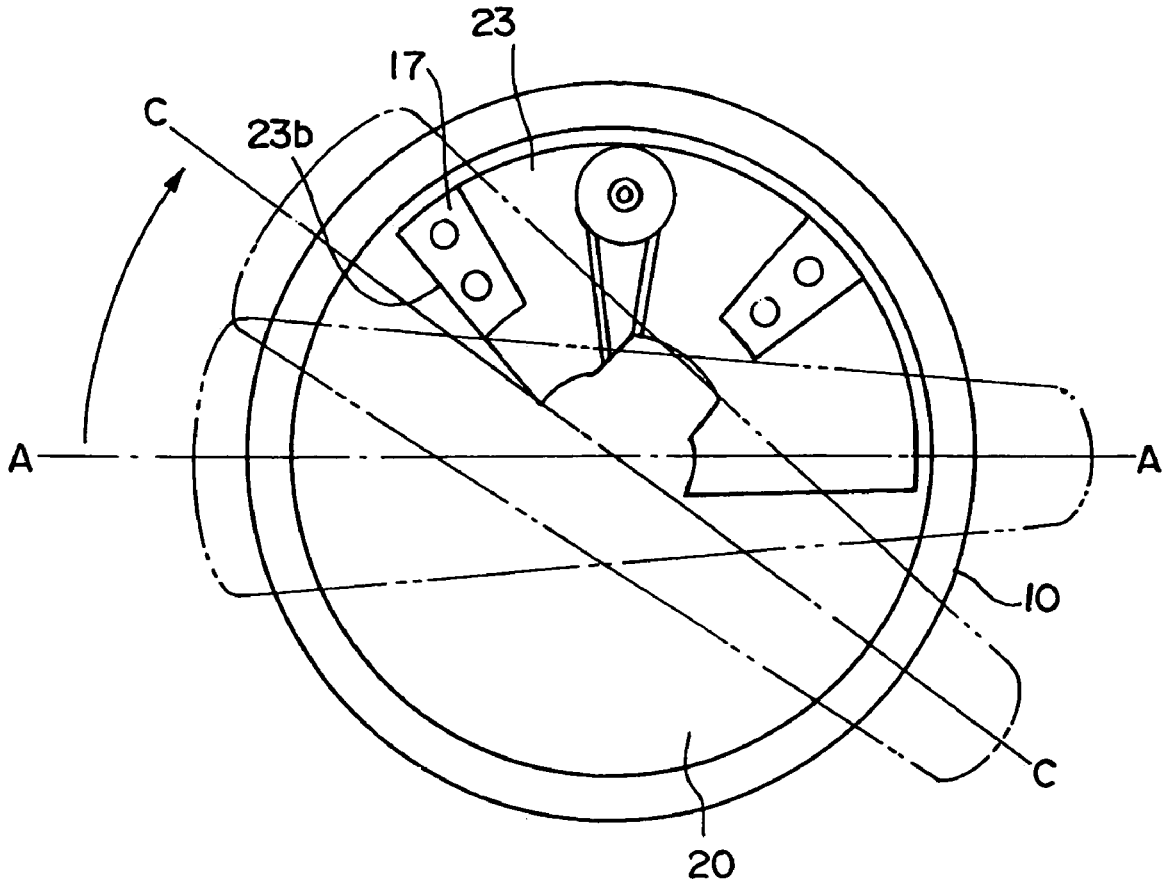
FIG. 9 is a schematic explanatory view showing a rotating state of the rotor member in a clockwise direction.

Next, a case of snowboarding using the binding device for snowboard of the present invention will be described with reference to FIGS. 7 to 9. The binding device 1 is represented in a simplified way in FIGS. 7 to 9.

Figure 7:
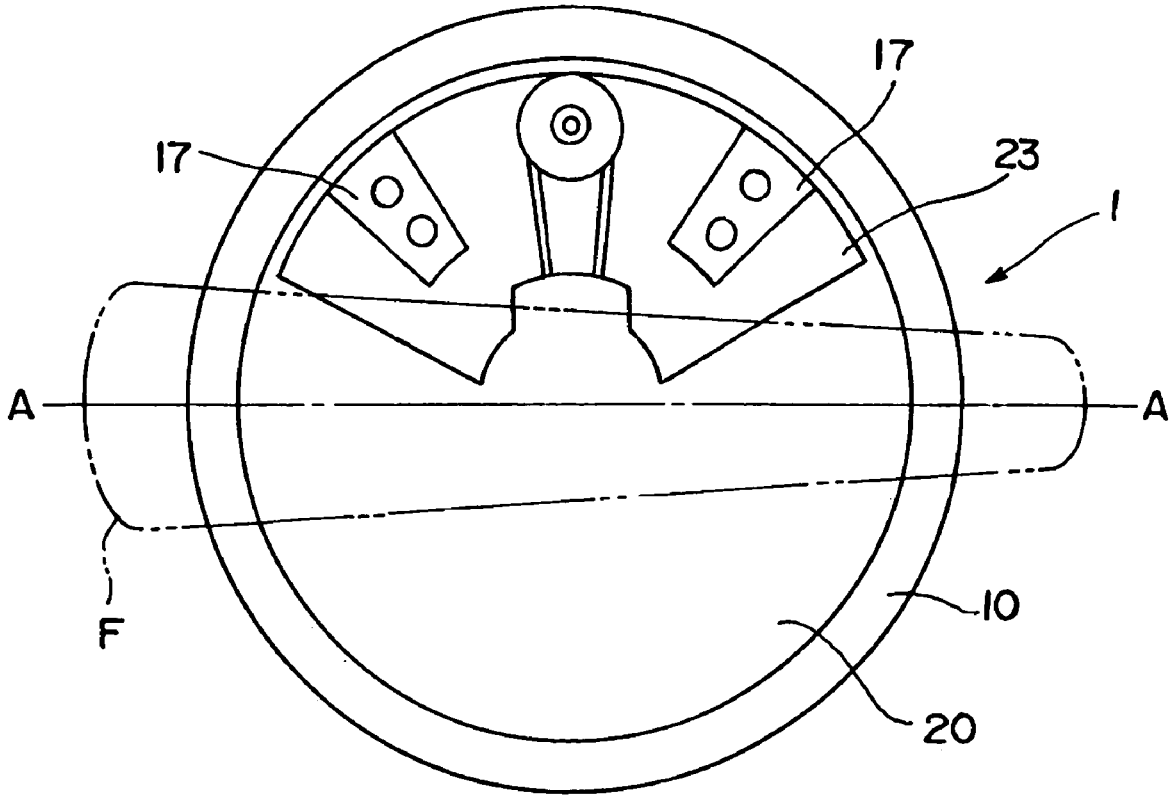
FIG. 7 is a schematic explanatory view showing the rotor member at a standard position.

First, snowboarding is started with a foot F located at a reference position A as shown in FIG. 7. If a force of rotating the rotor member 20 to the left is applied to the rotor member 20 by the foot F for a turn or other reason as shown in FIG. 8, the rotor member 20 rotates in a counterclockwise direction with respect to the base member 10, so that the foot F is moved from position A to position B.

Even if a larger force than necessary is applied to the foot F (the rotor member 20), the end portion 23*a* of the opening portion 23 comes into contact with the limiter 17, thereby restricting the rotation of the rotor member 20. If the aforementioned force is released after the turn or the like ends, the rotor member 20 is restored to the reference position A accurately by the restoring means 30 and the magnets 26, 27.

When the rotor member 20 leaves the reference position A or returns to the reference position A, the feeling of clicking occurs due to attractive force of the magnets 26, 27, so that the user can recognize that the rotor member 20 has left or returned to the reference position A.

If a force of rotating the rotor member 20 to the right is applied to the rotor member 20 by the foot F for a turn opposite to the above-described case, the rotor member 20 is rotated in a clockwise direction with respect to the base member 10 attached to the snowboard, so that the foot F is moved from position A to position C.

At this time, if a larger force than necessary is applied to the foot F (rotor member 20), the end portion 23*b* of the opening portion 23 comes into contact with the limiter 17 like the above-described case, thereby restricting the rotation of the rotor member 20. If the force is released after the turn or the like ends, the rotor member 20 is restored to the reference position A accurately by the restoring means 30 and the magnets 26, 27.

When the rotor member 20 leaves or returns to the reference position A, the feeling of clicking occurs due to the attractive force of the magnets 26, 27, so that the user can recognize that the rotor member 20 has left or returned to the reference position A.

Because the rotor member 20 rotates corresponding to the motion of the foot F, the user can change the direction of a stance during snowboarding, for example, to alpine style or free style smoothly depending on the circumstances, so that the user can take more pleasure in snowboarding.

The rotor member 20 is restored accurately to the reference position A by the restoring means 30 and the magnets 26, 27. Further, the feeling of clicking occurs by the attractive force of the magnets 26, 27 when the rotor member 20 leaves the reference position A or returns to the reference position A, so that the user can recognize that the rotor member 20 has left and returned to the reference position A.

Further, even if a large force is applied to the foot F due to fall down or the like, the rotation of the rotor member 20 is restricted by the limiter 17, thereby preventing the knee, ankle or the like from being damaged.

If the user wants to snowboard with the binding fixed to the snowboard, the rotor member 20 can be fixed by inserting the pin 3 into the communication hole 2, thereby preventing the rotor member 20 from rotating.

Although the above embodiment has been explained by referring to an example that the fan-like opening portion 23 is provided in the rotor member 20, the rotor member 20 may be provided with a concave construction instead of being provided with the opening portion 23, so that the side wall of the concave portion comes into contact with the limiter.

Figure 10:
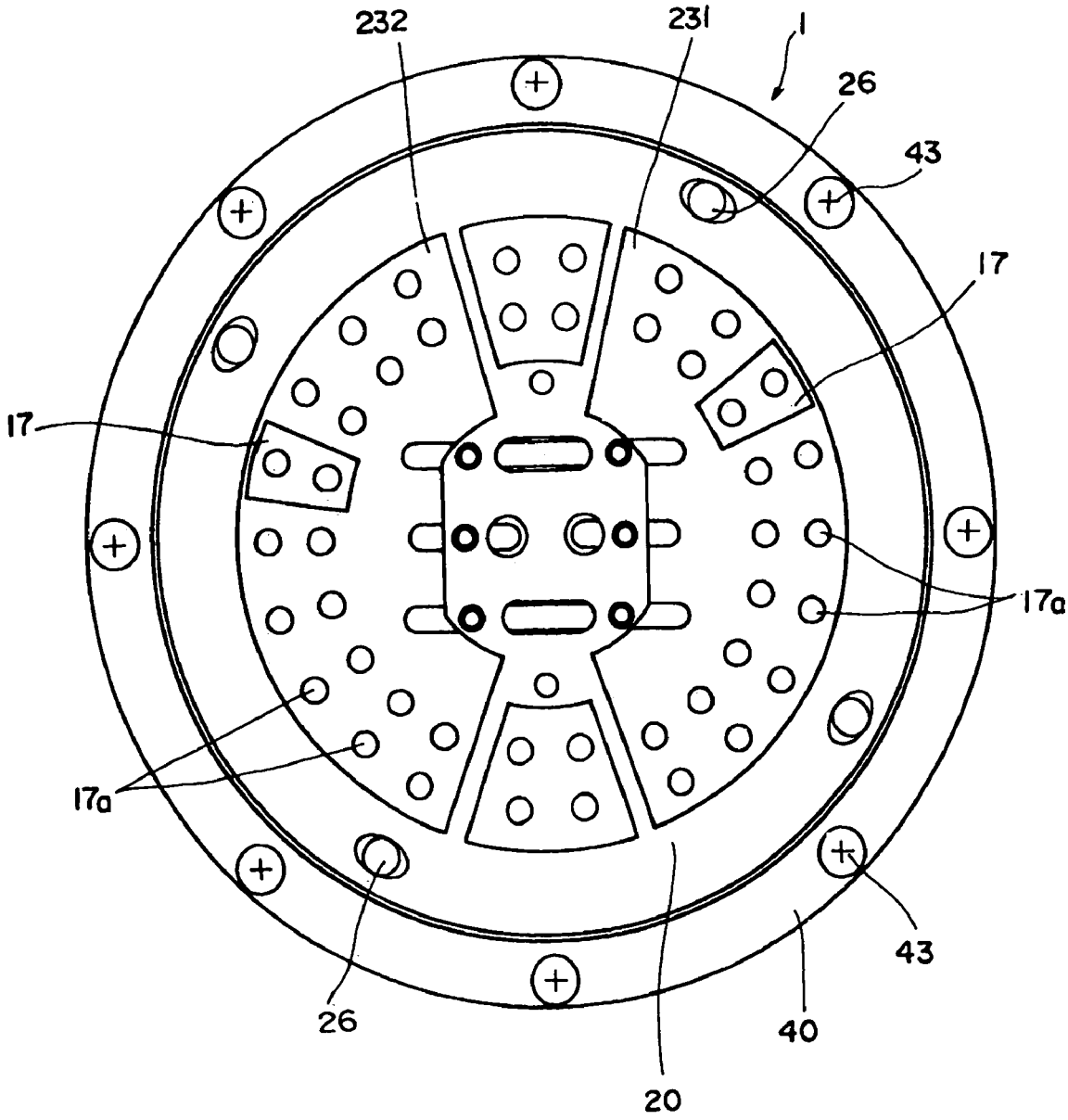
FIG. 10 is a plan view of a binding device for snowboard according to another embodiment.
Figure 11:
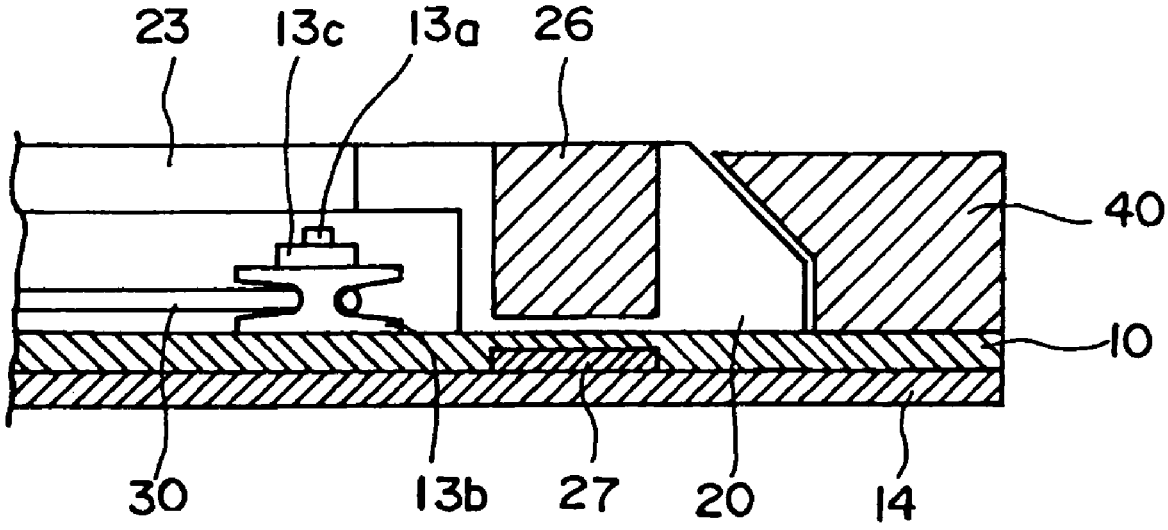
FIG. 11 is a sectional view showing a modification of a base member and a holding member.

As shown in FIG. 10, by providing two fan-like opening portions 231, 232, the limiter 17 may be provided for each of the opening portions 231, 232. By providing the opening portions 231, 232, the weight of the rotor member 20 can be reduced, and further, the rotation of the rotor member 20 can be restricted by the limiters 17. In the meantime, description of other configurations and other operating effects is omitted because they are equal to the above-described embodiment, while like reference numerals are attached thereto.

Although in the above embodiment, the limiter is provided on the base member as the rotation restricting means and the opening portion is formed in the rotor member, the present invention is not restricted to this example. A protrusion may be formed on the bottom face of the rotor member so that the protrusion comes into contact with the limiter.

Figure 14:
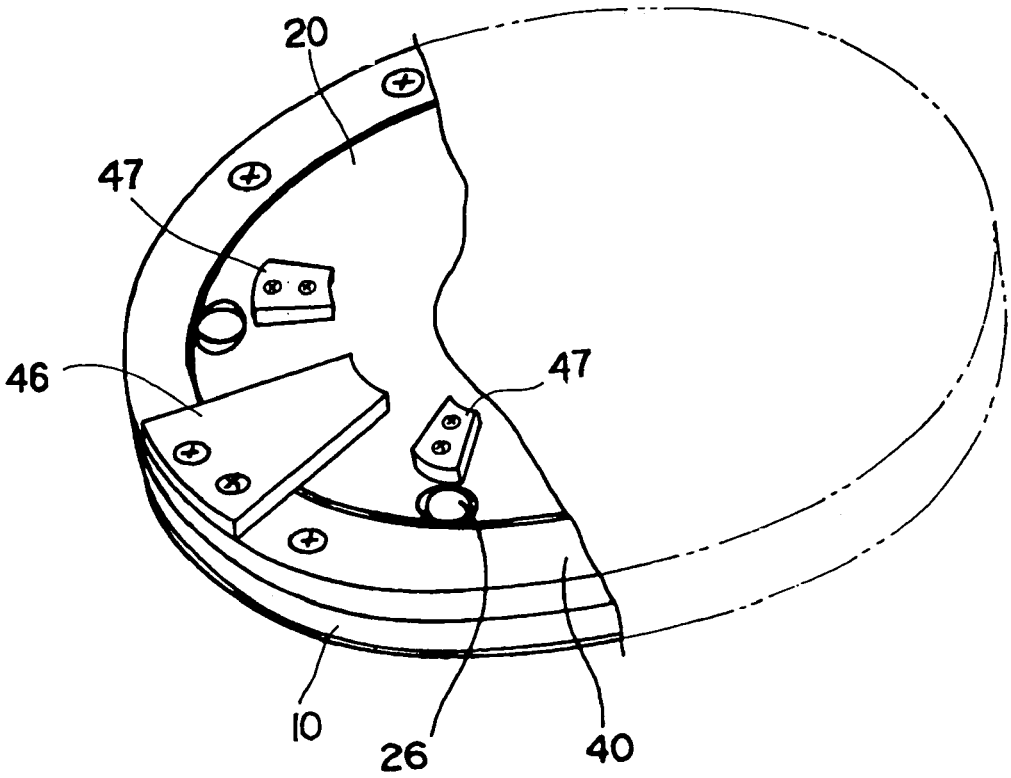
FIG. 14 is a perspective view showing a modification of rotation blocking means.
Figure 15:
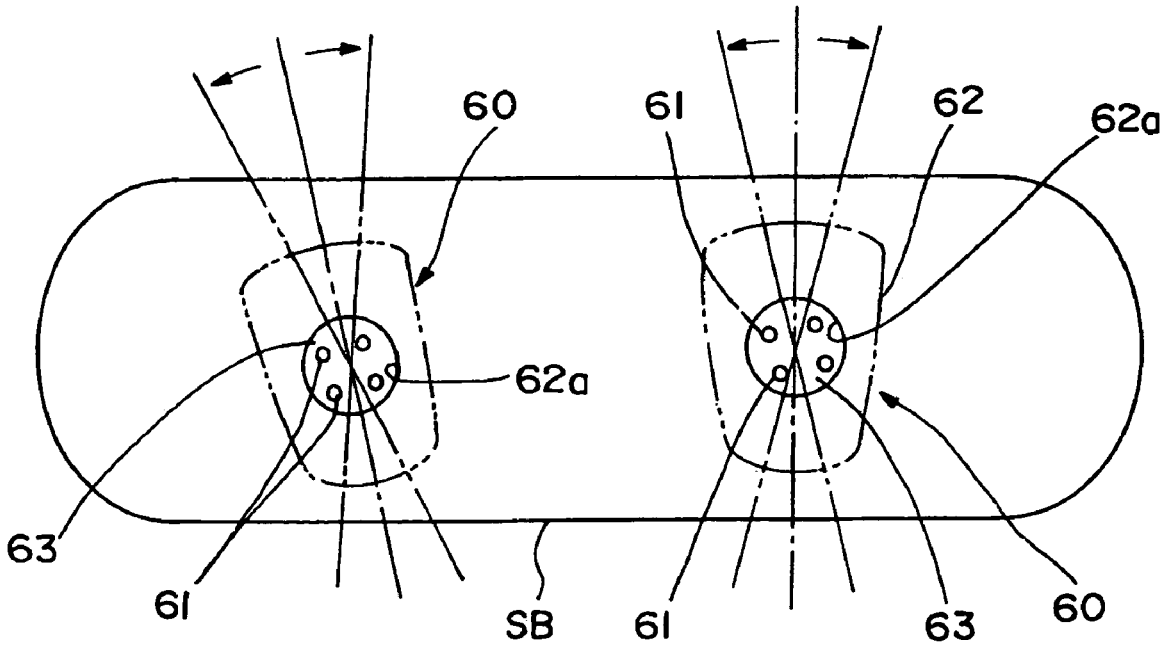
FIG.15 Prior Art
FIG. 15 is an explanatory view of a conventional binding mounting structure.
Figure 16:
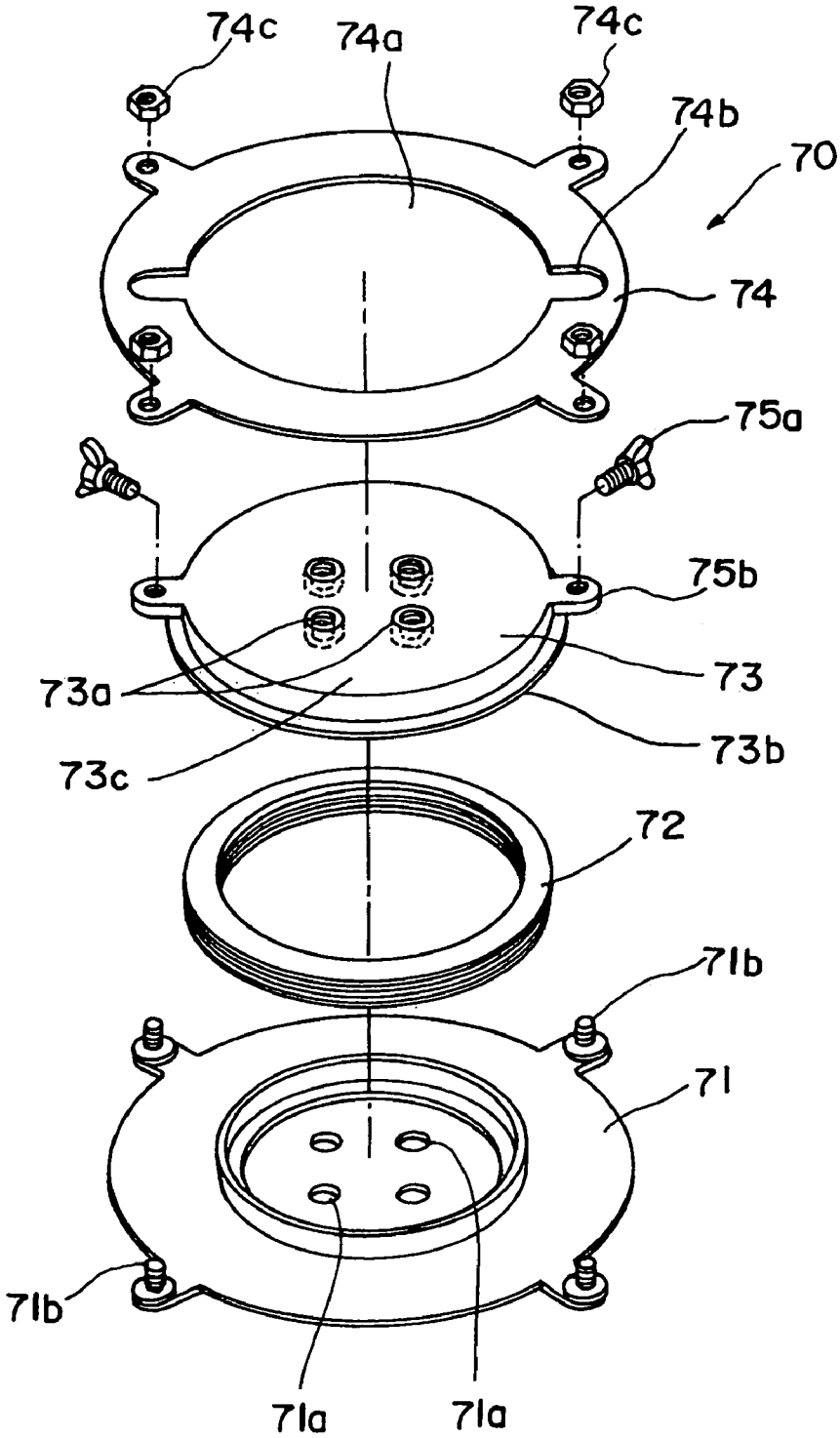
FIG.16 Prior Art
FIG. 16 is an exploded perspective view of a setting device for a conventional binding.

Further, it is permissible to provide a projecting portion 46 projecting to the side of the rotor member 20 on the top face of the holding member 40 and provide a projecting portion 47 on the top face of the rotor member 20 as shown in FIG. 14, so that the projecting portion 47 makes contact with the projecting portion 46 to block the rotation of the rotor member 20.

According to the above embodiment, the step portion 12 is formed on the periphery of the base member 10 and the accommodating portion 13 is formed inside of the step portion 12. Further, the holding member 40 is mounted on the top face of the step portion 12 to prevent the rotor member 20 from falling down.

The present invention is not restricted to this example but it is permissible to mount the holding member 40 to the flat base member 10 without forming the step portion of the base member 10 to thereby prevent the rotor member 20 from falling down.

In the above embodiment, the restoring means 30 is constructed to be wound around the roller 13*b* supported rotatably by the pin 13*a* formed in the accommodating portion so as to change the direction by 180°.

Figure 12:
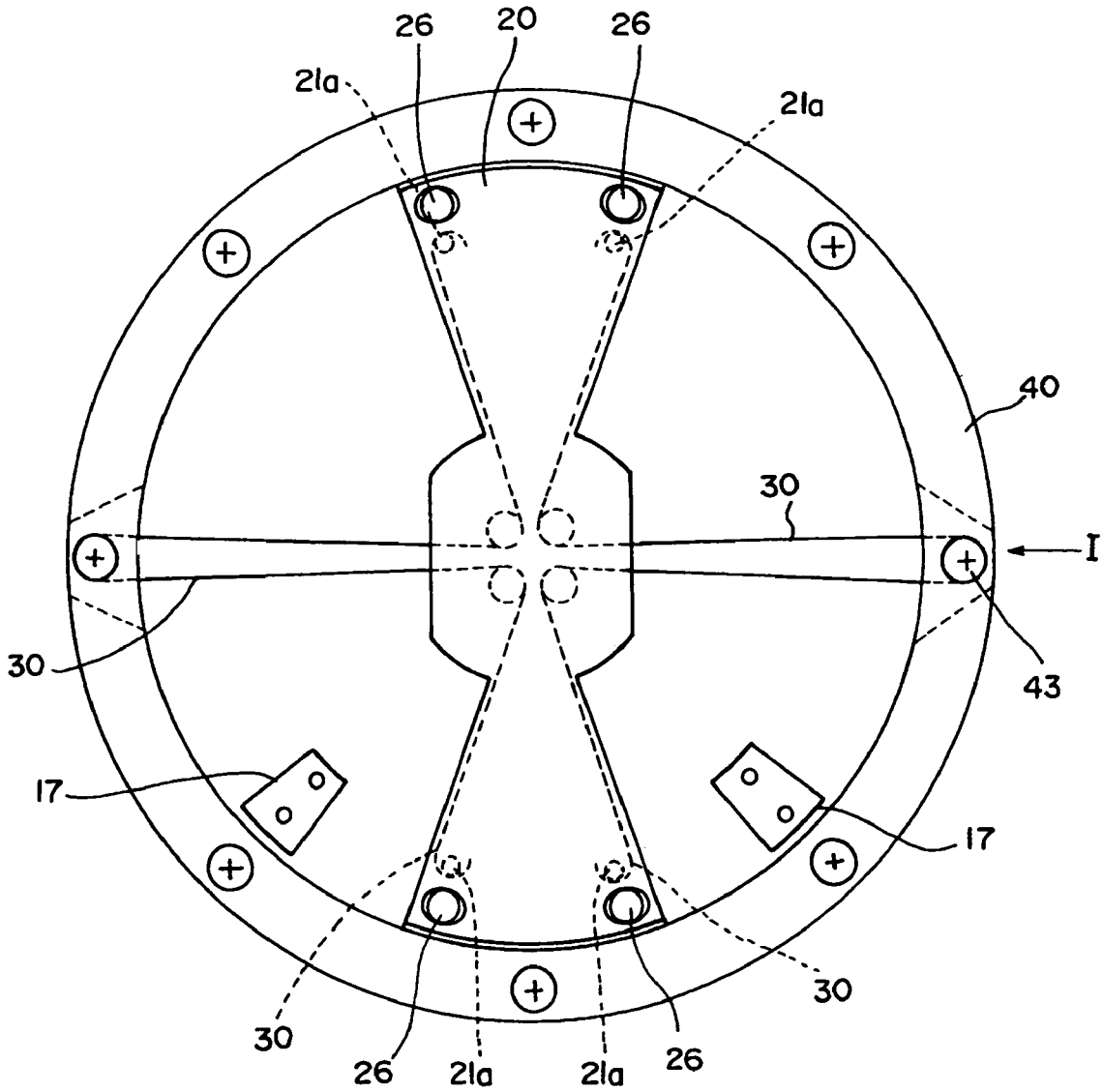
FIG. 12 is a plan view showing a modification of a pin and a roller.
Figure 13:
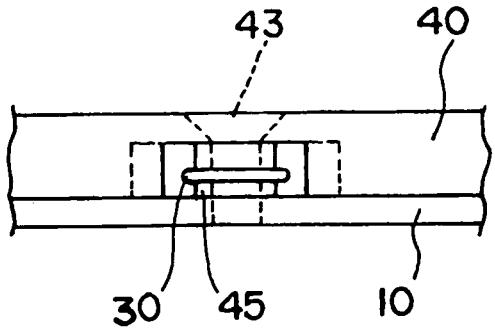
FIG. 13 is a side view of FIG. 12 as seen in the direction of I.

The present invention is not restricted to this example, but as shown in FIGS. 12 and 13, it is permissible to support the roller 45 rotatably with the screw 43 for fixing the holding member 40 to the base member 10 and wind the restoring member 30 around the roller 45 so as to change the direction by 180°.

What is claimed is:

1. A binding device for snowboard, comprising:

a base member mounted on a snowboard;

a rotor member provided rotatably on the base member and having attaching means for attaching a binding member and fixing means for fixing a shoe on a top face thereof;

a holding member mounted on a top face of the base member, for holding the rotor member rotatably;

a spring member provided and stretched between the base member or the holding member and the rotor member, for restoring the rotor member to a reference position, and magnets having different magnetic poles provided at opposing positions of the base member and the rotor member or at opposing positions of the holding member and the rotor member.

2. The binding device for snowboard according to claim 1, wherein rotor rotation blocking means is provided on the base member or the holding member, and rotation of the rotor member is blocked when the rotor member comes into contact with the rotor rotation blocking means.

3. The binding device for snowboard according to claim 1, further comprising a communication hole which is open in the base member or the holding member such that it communicates with an inside of the rotor member, wherein the rotor member is fixed to the base member or the holding member by inserting a pin into the communication hole.

* * * * *